US006549502B1

(12) United States Patent
Lagasse

(10) Patent No.: US 6,549,502 B1
(45) Date of Patent: Apr. 15, 2003

(54) VOICE MAIL FLOOR MAT

(76) Inventor: Russell N. Lagasse, P.O. Box 286, Atkinson, NH (US) 03811

( * ) Notice: Subject to any disclaimer, the term of this patent is extended or adjusted under 35 U.S.C. 154(b) by 85 days.

(21) Appl. No.: 09/770,270

(22) Filed: Jan. 26, 2001

(51) Int. Cl.[7] ..... A63H 3/33
(52) U.S. Cl. ..... 369/63
(58) Field of Search ..... 369/63, 69, 85; 5/417–420; D6/582, 583; 379/67.1, 68, 83, 70; 340/666, 692; 200/86 R

(56) References Cited

U.S. PATENT DOCUMENTS

| | | | | |
|---|---|---|---|---|
| 4,023,151 A | | 5/1977 | Markham | 340/692 |
| 4,497,989 A | | 2/1985 | Miller | 200/86 R |
| 4,715,060 A | | 12/1987 | Lipscher et al. | 379/70 |
| 5,072,467 A | * | 12/1991 | Hunt | 401/201 |
| 5,210,528 A | | 5/1993 | Schulman et al. | 340/666 |
| 5,278,808 A | * | 1/1994 | Takano | 369/11 |
| D350,253 S | | 9/1994 | Livingstone et al. | D6/583 |
| 5,963,530 A | | 10/1999 | Ward | 369/85 |

* cited by examiner

*Primary Examiner*—Brian E. Miller
*Assistant Examiner*—Julie Anne Watko

(57) ABSTRACT

A voice mail floor mat for greeting guests and allowing them to leave messages if nobody is at home. The voice mail floor mat includes a housing assembly including a housing having a top, wall and a bottom wall and being generally flat and also having a definite thickness; and also includes a voice mail assembly being disposed in the housing and including a voice recorder, a message player, sensors for activating the message player, and a recording switch member for energizing the voice recorder.

8 Claims, 1 Drawing Sheet

VOICE MAIL FLOOR MAT

BACKGROUND OF THE INVENTION

1. Field of the Invention

The present invention relates to a floor mat and more particularly pertains to a new voice mail floor mat for greeting guests and allowing them to leave messages if nobody is at home.

2. Description of the Prior Art

The use of a floor mat is known in the prior art. More specifically, a floor mat heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,210,528; U.S. Pat. No. 4,023,151; U.S. Pat. No. 4,715,060; U.S. Pat. No. 4,497,989; U.S. Pat. No. 5,963,530; and U.S. Pat. No. Des. 350,253.

While these devices fulfill their respective, particular objectives and requirements, the aforementioned patents do not disclose a new voice mail floor mat. The inventive device includes a housing assembly including a housing having a top wall and a bottom wall and being generally flat and also having a definite thickness; and also includes a voice mail assembly being disposed in the housing and including a voice recorder, a message player, sensors for activating the message player, and a recording switch member for energizing the voice recorder.

In these respects, the voice mail floor mat according to the present invention substantially departs from the conventional concepts and designs of the prior art, and in so doing provides an apparatus primarily developed for the purpose of greeting guests and allowing them to leave messages if nobody is at home.

SUMMARY OF THE INVENTION

In view of the foregoing disadvantages inherent in the known types of floor mat now present in the prior art, the present invention provides a new voice mail floor mat construction wherein the same can be utilized for greeting guests and allowing them to leave messages if nobody is at home.

The general purpose of the present invention, which will be described subsequently in greater detail, is to provide a new voice mail floor mat which has many of the advantages of the floor mat mentioned heretofore and many novel features that result in a new voice mail floor mat which is not anticipated, rendered obvious, suggested, or, even implied by any of the prior art floor mat, either alone or in any combination thereof.

To attain this, the present invention generally comprises a housing assembly including a housing having a top wall and a bottom wall and being generally flat and also having a definite thickness; and also includes a voice mail assembly being disposed in the housing and including a voice recorder, a message player, sensors for activating the message player, and a recording switch member for energizing the voice recorder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new voice mail floor mat which has many of the advantages of the floor mat mentioned heretofore and many novel features that result in a new voice mail floor mat which is not anticipated, rendered obvious, suggested, or even implied by any of the prior art floor mat, either alone or in any combination thereof.

It is another object of the present invention to provide a new voice mail floor mat which may be easily and efficiently manufactured and marketed.

It is a further object of the present invention to provide a new voice mail floor mat which is of a durable and reliable construction.

An even further object of the present invention is to provide a new voice mail floor mat which is susceptible of a low cost of manufacture with regard to both materials and labor, and which accordingly is then susceptible of low prices of sale to the consuming public, thereby making such voice mail floor mat economically available to the buying public.

Still yet another object of the present invention is to provide a new voice mail floor mat which provides in the apparatuses and methods of the prior art some of the advantages thereof, while simultaneously overcoming some of the disadvantages normally associated therewith.

Still another object of the present invention is to provide a new voice mail floor mat for greeting guests and allowing them to leave messages if nobody is at home.

Yet another object of the present invention is to provide a new voice mail floor mat which includes a housing assembly including a housing having a top wall and a bottom wall and being generally flat and also having a definite thickness; and also includes a voice mail assembly being disposed in the housing and including a voice recorder, a message player, sensors for activating the message player, and a recording switch member for energizing the voice recorder.

Still yet another object of the present invention is to provide a new voice mail floor mat that is easy and convenient to use.

Even still another object of the present invention is to provide a new voice mail floor mat that lets the user know who may have been at one's house.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
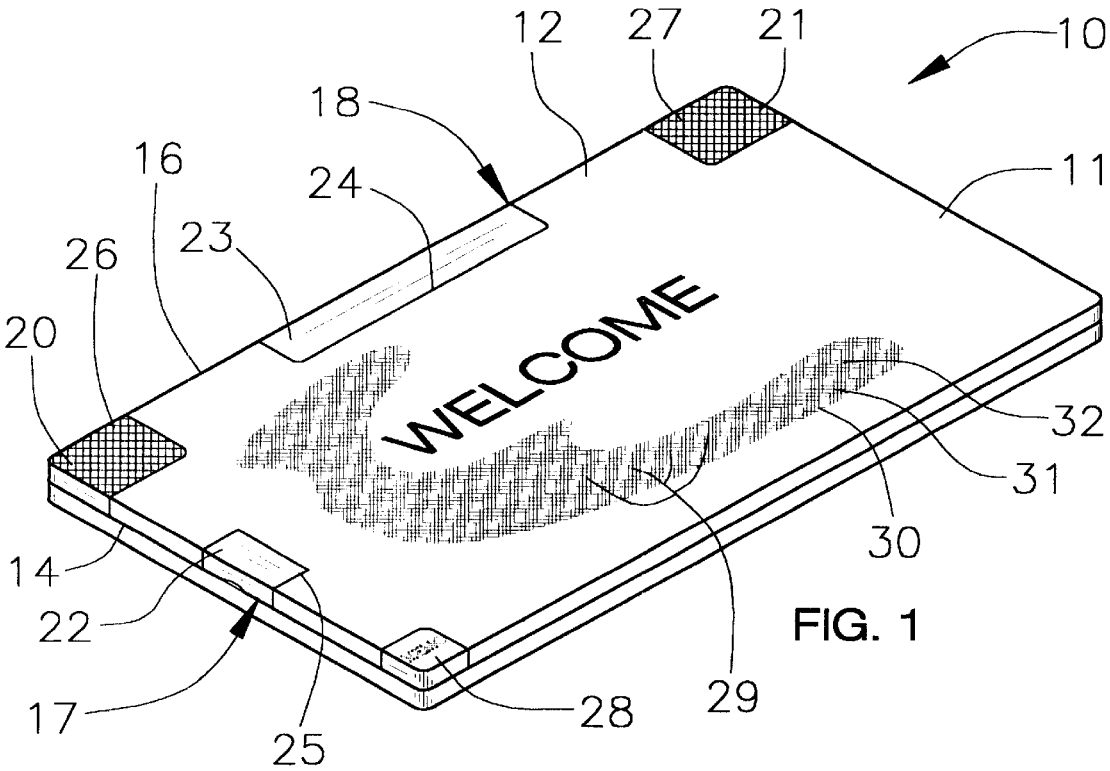
FIG. 1 is a top perspective view of a new voice mail floor mat according to the present invention.
Figure 2:
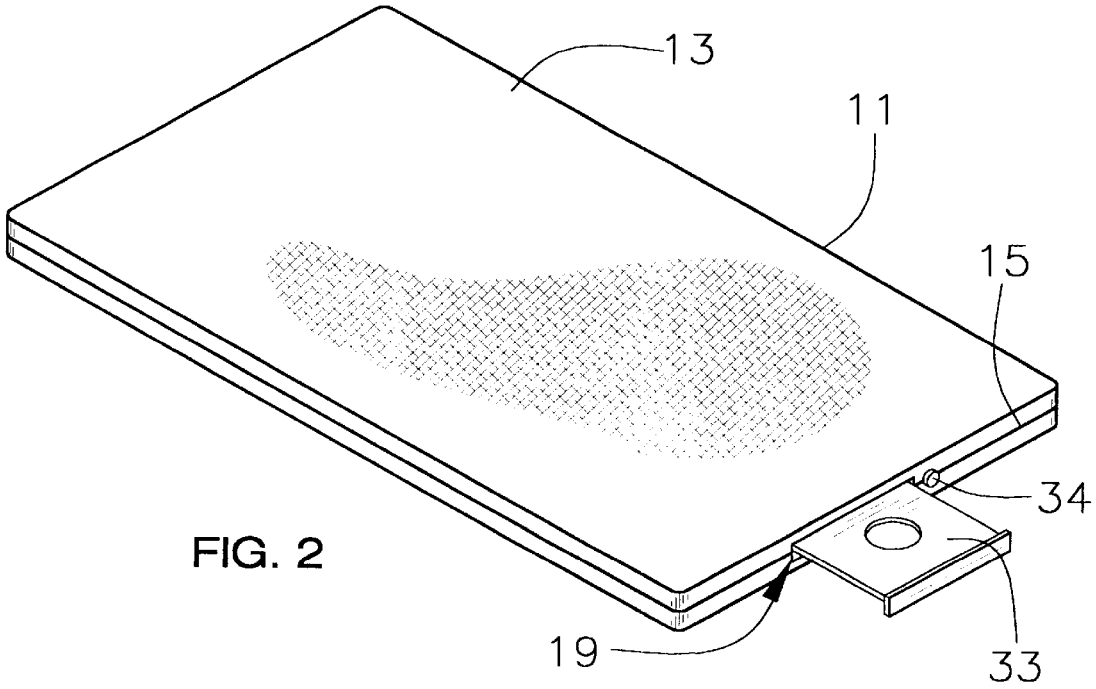
FIG. 2 is a bottom perspective view of the present invention.

With reference now to the drawings, and in particular to FIGS. 1 through 2 thereof, a new voice mail floor mat embodying the principles and concepts of the present invention and generally designated by the reference numeral 10 will be described.

As best illustrated in FIGS. 1 through 2, the voice mail floor mat 10 generally comprises a housing assembly including a housing 11 having a top wall 12 and a bottom wall 13 and being generally flat and also having a definite thickness. The housing 11 is made of a flexible material including rubber, fabric, and polymeric. The housing 11 further includes mesh members 20,21 being conventionally disposed along a perimeter of and in the top wall 12 thereof, and also includes a first opening 17 being disposed through a portion of the top wall 12 and through a portion of a first side end 14 thereof, and further includes a second opening 18 being disposed through a portion of the top wall 12 and through a portion of a back end 16 thereof, and also includes a third opening 19 being disposed through a second side end 15 thereof. The housing assembly further includes a first cover member 22 being removably and conventionally disposed over the first opening 17, and also includes a second cover member 23 being removably and conventionally disposed over the second opening 18 with the housing 11 being generally rectangular.

A voice mail assembly is conventionally disposed in the housing 11 and includes a voice recorder 24, a message player, sensors 29 for activating the message player 33, and a recording switch member 28 for energizing the voice recorder 24. The voice recorder 24 is conventionally disposed in the housing 11 through the second opening 18. The voice mail assembly further includes a battery pack 25 being removably and conventionally disposed in the housing 11 through the first opening 17 and being conventionally connected to the voice recorder 24. The voice mail assembly also includes speakers 26,27 being conventionally disposed in the housing 11 beneath the mesh members 20,21 and being conventionally connected to the voice recorder 24. The message player includes a CD carriage 33 being conventionally disposed in the housing 11 and being retractably extendable from the housing 11 through the third opening 19, and also includes a button-like switch member 24 being depressibly and conventionally disposed in the second side end 15 of the housing 11 adjacent to the third opening 19 for extending the CD carriage 33 from the housing 11 with the message player being conventionally connected to the speakers 26,27. The sensors 29 are spaced about and are conventionally disposed in the top wall 12 of the housing 11 and are conventionally connected to the message player and to the battery pack 25 with the sensors 29 including a bottom layer of contact material 30, a separating layer of material 31 being conventionally disposed upon the bottom layer 30, and a top layer of contact material 32 being conventionally disposed upon the separating layer 31 and being contactable with the bottom layer of contact material 30 upon the top layer of contact material 32 being pressed upon to activate the message player. The recording switch member 28 is depressibly and conventionally disposed at a portion of the perimeter of the housing 11 and is conventionally connected to the voice recorder 24 and to the battery pack 25 for activating the voice recorder 24 upon being depressed. The recording switch member 28 is non-depressibly flush with the top wall 12 of the housing 11.

In use, the user sets up the housing 11 upon a ground near a door of a dwelling and records a message on the message player. Upon a guest stepping upon the voice mail floor mat 10, the sensors 29 activate the message player and an audible message is announced through the speakers 26,27. The guest can leave a message for the user by depressing upon the recording switch member 28 which activates the voice recorder 24 allowing the guest to leave a message for the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A voice mail floor mat comprising:

a housing assembly including a housing having a top wall and a bottom wall and being generally flat and also having a definite thickness;

a voice mail assembly being disposed in said housing and including a voice recorder, a message player, sensors for activating said message player, a recording switch member for energizing said voice recorder; and wherein said housing further includes mesh members being disposed along a perimeter of and in said top wall thereof, and also includes a first opening being disposed through a portion of said top wall and through a portion of a first side end thereof, and further includes a second opening being disposed through a portion of said top wall and through a portion of a back end thereof, and also includes a third opening being disposed through a second side end thereof.

2. A voice mail floor mat as described in claim 1, wherein said housing is made of a flexible material.

3. A voice mail floor mat as described in claim 1, wherein said housing assembly further includes a first cover member being removably disposed over said first opening, and also includes a second cover member being removably disposed over said second opening.

4. A voice mail floor mat as described in claim 1, wherein said voice recorder is disposed in said housing through said second opening, said voice mail assembly further including a battery pack being removably disposed in said housing through said first opening and being connected to said voice recorder, said voice mail assembly also including speakers being disposed in said housing beneath said mesh members and being connected to said voice recorder.

5. A voice mail floor mat as described in claim 4, wherein said message player includes a CD carriage being disposed in said housing and being retractably extendable from said housing through said third opening, and also includes a button-like switch member being depressibly disposed in said second side end of said housing adjacent to said third opening for extending said CD carriage from said housing, said message player being connected to said speakers.

6. A voice mail floor mat as described in claim 5, wherein said sensors are spaced about and are disposed in said top wall of said housing and are connected to said message player and to said battery pack, said sensors including a bottom layer of contact material, a separating layer of material being disposed upon said bottom layer, and a top layer of contact material being disposed upon said separating layer and being contactable with said bottom layer of contact material upon said top layer of contact material being pressed upon to activate said message player.

7. A voice mail floor mat as described in claim 4, wherein said recording switch member is depressibly disposed at a portion of said perimeter of said housing and is connected to said voice recorder and to said battery pack for activating said voice recorder upon being depressed, said recording switch member being flush with said top wall of said housing.

8. A voice mail floor mat comprising:

a housing assembly including a housing having a top wall and a bottom wall and being generally flat and also having a definite thickness, said housing being made of a flexible material including rubber, fabric, and polymeric, said housing further including mesh members being disposed along a perimeter of and in said top wall thereof, and also including a first opening being disposed through a portion of said top wall and through a portion of a first side end thereof, and further including a second opening being disposed through a portion of said top wall and through a portion of a back end thereof, and also including a third opening being disposed through a second side end thereof, said housing assembly further including a first cover member being removably disposed over said first opening, and also including a second cover member being removably disposed over said second opening, said housing being generally rectangular; and a voice mail assembly being disposed in said housing and including a voice recorder, a message player, sensors for activating said message player, a recording switch member for energizing said voice recorder, said voice recorder being disposed in said housing through said second opening, said voice mail assembly further including a battery pack being removably disposed in said housing through said first opening and being connected to said voice recorder, said voice mail assembly also including speakers being disposed in said housing beneath said mesh members and being connected to said voice recorder, said message player including a CD carriage being disposed in said housing and being retractably extendable from said housing through said third opening, and also including a button-like switch member being depressibly disposed in said second side end of said housing adjacent to said third opening for extending said CD carriage from said housing, said message player being connected to said speakers, said sensors being spaced about and being disposed in said top wall of said housing and being connected to said message player and to said battery pack, said sensors including a bottom layer of contact material, a separating layer of material being disposed upon said bottom layer, and a top layer of contact material being disposed upon said separating layer and being contactable with said bottom layer of contact material upon said top layer of contact material being pressed upon to activate said message player, said recording switch member being depressibly disposed at a portion of said perimeter of said housing and is connected to said voice recorder and to said battery pack for activating said voice recorder upon being depressed, said recording switch member being flush with said top wall of said housing.

* * * * *